US006299277B1

(12) United States Patent
Fujii

(10) Patent No.: US 6,299,277 B1
(45) **Date of Patent: *Oct. 9, 2001**

(54) INK JET PRINTER FOR MONITORING AND REMOVING THICKENED INK FROM PRINT HEAD

(75) Inventor: Hiroyuki Fujii, Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/911,386

(22) Filed: Aug. 14, 1997

(30) Foreign Application Priority Data

Sep. 18, 1996 (JP) ..... 8-268002

(51) Int. Cl.[7] ..... B41J 2/165
(52) U.S. Cl. ..... 347/23
(58) Field of Search ..... 347/23, 14, 22, 347/29, 30

(56) References Cited

U.S. PATENT DOCUMENTS 4,540,997 * 9/1985 Biggs et al. ..... 347/23
4,577,203 * 3/1986 Kawamura ..... 347/30
4,692,777 * 9/1987 Hasumi ..... 347/23
4,970,527 * 11/1990 Gatten ..... 347/23

FOREIGN PATENT DOCUMENTS 3-183560 * 8/1991 (JP) ..... 347/23

* cited by examiner

*Primary Examiner*—Judy Nguyen
(74) *Attorney, Agent, or Firm*—Hogan & Hartson L.L.P.

(57) ABSTRACT

An ink jet printer measures a time period over which a print head thereof is in intimate contact with a head cap thereof, and based on results of the measurement regularly removes thickened ink adhering to the print head. An ink jet printer according to another form measures a time period over which the print head is in a state in which ink is neither delivered therefrom nor drawn therein, and a parameter related to an evaporation rate of a solvent or water from the ink. The ink jet printer removes thickened ink adhering to the print head based on the measured time period and the measured parameter.

8 Claims, 5 Drawing Sheets

INK JET PRINTER FOR MONITORING AND REMOVING THICKENED INK FROM PRINT HEAD

BACKGROUND OF THE INVENTION

1. Field of the Invention

This invention relates to an ink jet printer which is capable of removing thickened ink by cleaning, flushing, or the like.

2. Prior Art

Conventionally, this kind of ink jet printer removes ink (hereinafter referred to as "thickened ink") which is solidifying through evaporation of a solvent, such as water in the case of a water-soluble ink, by cleaning or flushing.

For example, the thickened ink is removed when printing is started after the lapse of a predetermined time period from termination of the immediately preceding printing operation, or when printing is started after replacement of an ink cartridge, or when the user has found a defective print quality, or on like occasions. In removing the thickened ink, as shown in FIG. 1, a head cap 24 is brought into intimate contact with a print head 21 which is arranged at an end of a carriage 23 having an ink cartridge 29 loaded therein, whereby nozzles 22 of the print head 21 are blocked. Then, a pump 28 is operated to collect or draw the thickened ink via an ink absorbent 25 and an ink collecting tube 27 into an ink absorbent 26. Alternatively, wiping or wrapping of the surface of the print head 21, that is, cleaning of the same, is carried out.

When the printer has continued to be in an operating state in which the head cap 24 is not in intimate contact with the print head 21 over a predetermined time period, or when printing is terminated, the carriage 23 is returned from a printing area PA to the home position HP to bring the print head 21 into contact with the head cap 24, and then a slight amount of ink is caused to be delivered through all the nozzles 22 of the print head 21. In short, flushing is carried out. Further, immediately after the main power supply is turned on, one of or both of the cleaning and flushing operations are carried out. Through these operations, thickened ink formed at openings of the nozzles 22 and ink passages adjacent thereto is removed to thereby prevent the nozzles 22 and the passages from being clogged.

However, according to the conventional ink jet printer, even if the printer is in a non-printing state, i.e. in a state where the print head 21 is in intimate contact with the head cap 24, if the printer is left unused with the ink cartridge 29 loaded therein for a long time period (e.g. several months), portions of ink not only within the nozzles 22 but also within ink passages extending from the ink cartridge 29 to the nozzles 22 solidify through evaporation of a solvent or water, so that the nozzles 22 and the ink passages are clogged. In such cases, the cleaning and/or flushing normally executed when the printer is started is not sufficient for restoring a normal operative state of the printer in which printing can be properly carried out. To recover from such a malfunction of the printer, it is required to set a new ink cartridge 29 to dissolve the solidified ink, or to carry out the cleaning of the print head 21 several times by the use of the pump 28, further, if required, to replace the print head 21 by a new one, which prevents the user from using the printer immediately as he desires, and causes him to take the trouble of restoring the normal operative state of the printer.

SUMMARY OF THE INVENTION

It is the object of the invention to provide an ink jet printer which can be used without a hitch even after the ink jet printer is left for a long time period in a non-printing state in which no ink is delivered or drawn from a print head thereof, such as a state in which the print head is in intimate contact with a head cap.

To attain the above object, according to a first aspect of the invention, there is provided an ink jet printer including a print head, and a head cap for being brought into intimate contact with the print head to cover the print head, comprising:

time-measuring means for measuring a time period over which the print head is in intimate contact with the head cap; and thickened ink-removing means for regularly removing thickened ink adhering to the print head based on a result of measurement by the time-measuring means.

According to this ink jet printer, even when it is in a non-printing state in which the print head is in intimate contact with head cap, the thickened ink is regularly removed. Therefore, even if the ink jet printer is left in the non-printing state for a long time period, it can preserve a condition in which its print head is removed of thickened ink. This enables the printer to perform its normal printing operations without a hitch even after it is left in the non-printing state for a long time. It should be noted that the removal of thickened ink can be executed by cleaning, flushing, or the like.

Preferably, the ink jet printer includes a main power supply for supplying electric power to the ink jet printer for a printing operation thereof, and an auxiliary power supply for supplying electric power to the time-measuring means and the thickened ink-removing means when the main power supply is off.

According to this preferred embodiment, when the main power is off, the time-measuring means and the thickened ink-removing means are supplied with electric power by the auxiliary power supply. Therefore, even if the main power supply is off, the thickened ink can be removed without any problem. This enables the present ink jet printer to preserve the above advantageous features thereof to thereby permit the use thereof immediately as desired by the user.

For example, the auxiliary power supply is a battery.

Preferably, the thickened ink-removing means carries out flushing to remove the thickened ink adhering to the print head.

According to this preferred embodiment, the above advantageous effects can be obtained by execution of the flushing for removing the thickened ink.

Preferably, the thickened ink-removing means carried out the flushing whenever the time period measured by the time-measuring means reaches a predetermined time period.

For example, the time-measuring means is a timer which is reset whenever the flushing is carried out.

To attain the above object, according to a second aspect of the invention, there is provided an ink jet printer including a print head, and a head cap for being brought into intimate contact with the print head to cover the print head, the ink jet printer using an ink in the form of a solution having a solvent, comprising:

time-measuring means for measuring a time period over which the print head is in a state in which the ink is neither delivered therefrom nor drawn therein;

evaporation rate parameter-measuring means for measuring a parameter related to an evaporation rate of the solvent from the ink; and thickened ink-removing means for removing thickened ink adhering to the print head based on a result of measurement by the time-measuring means and a result of measurement by the evaporation rate parameter-measuring means.

In general, a time period over which an ink for ink jet printers solidifies through evaporation of a solvent of the ink varies with a parameter related to the evaporation rate of the solvent of the ink, which is detected in the environment of the ink jet printer (e.g. relative humidity in the case of a water-soluble ink which uses water as the solvent, and an ambient temperature in the case of an oil-soluble ink which uses e.g. kerosene as the solvent). According to the ink jet printer of the second aspect of the invention, measurements are made not only on a time period over which the ink jet printer is in a non-printing state in which no ink is delivered from or drawn into the print head, such as a state in which the print head is in intimate contact with the head cap, or a state in which printing is inhibited due to other causes, but also on the parameter related to the evaporation rate of the solvent from the ink, and at a timing determined based on results of these measurements, the thickened ink is removed by cleaning or flushing. Therefore, even if the ink jet printer is left in the non-printing state for a long time period, the thickened ink can be removed by taking into account environmental conditions, which makes it possible to remove the thickened ink efficiently.

Preferably, the thickened ink-removing means comprises computing means for determining timing at which the removal of the thickened ink is to be carried out based on the time period measured by the time-measuring means and the parameter measured by the evaporation rate parameter-measuring means, and thickened ink removal-executing means for executing removal of the thickened ink adhering to the print head at the timing determined by the computing means.

According to this preferred embodiment, the timing for executing removal of the thickened ink is determined based on the time period measured by the time-measuring means and the parameter measured by the evaporation rate parameter-measuring means, and at the timing thus determined, the thickened ink is removed. Therefore, it is possible to remove the thickened ink efficiently by taking environmental conditions into account.

Further preferably, the ink is a water-soluble ink, the evaporation rate parameter-measuring means being a humidity sensor for measuring a relative humidity, the computing means determining an evaporation rate of water from the ink based on the relative humidity measured by the humidity sensor, determining an amount of evaporation of water from the ink over a very short time period based on the evaporation rate of water from the ink and the time period measured by the time-measuring means, cumulating the amount of evaporation of water from the ink over the very short time period to obtain a cumulative amount of evaporation of water from the ink, and determining the timing at which the removal of the thickened ink is to be carried out, based on the cumulative amount of evaporation of water from the ink.

In general, a time period over which a water-soluble ink for ink jet printers becomes dry to solidify is dependent on the evaporation rate of water from the ink, i.e. the amount of evaporation of water from the ink per unit time per unit area, and the evaporation rate of water depends on the relative humidity. The ink jet printer according to this preferred embodiment determines the evaporation rate of water from the ink from the measured value of the relative humidity, an amount of evaporation of water from the ink over a very short time period based on the evaporation rate of water from the ink and the time period measured by the time-measuring means, and cumulates the amount of evaporation of water from the ink over the very short time period to obtain a cumulative amount of evaporation of water from the ink. Based on this cumulative amount of evaporation of water from the ink, it is possible to determine suitable timing which fulfills necessary and sufficient conditions in executing the removal of thickened ink adhering to the print head. This enables the ink jet printer to flexibly cope with changes in the environment.

Further preferably, the thickened ink-removing means includes memory means storing a conversion table for converting the relative humidity to the evaporation rate of water from the ink, and the computing means determines the evaporation rate of water from the ink with reference to the conversion table.

According to this preferred embodiment, by storing the conversion table, the evaporation rate of water from the water-soluble ink can be easily determined by referring to the table. Further, the use of the conversion table makes the ink jet printer adaptable to use of a different kind of ink which has different characteristics only through changing values of the conversion table without changing the construction of component parts, such as the computing means and the like. Further, when a plurality of kinds of inks are used for printing, conversion tables can be provided respectively for these kinds of inks and stored in the memory means, which makes the ink jet printer applicable to wider ranges of inks.

Alternatively, the ink is an oil-soluble ink, the evaporation rate parameter-measuring means being a temperature sensor for measuring an ambient temperature, the computing means determining an evaporation rate of the solvent from the ink based on the ambient temperature measured by the temperature sensor, determining an amount of evaporation of the solvent from the ink over a very short time period based on the evaporation rate of the solvent from the ink and the time period measured by the time-measuring means, cumulating the amount of evaporation of the solvent from the ink over the very short time period, and determining the timing at which the removal of the thickened ink is to be carried out, based on the cumulative amount of evaporation of the solvent from the ink.

On the other hand, a time period over which an oil-soluble ink for ink jet printers solidifies through evaporation of the solvent is dependent on the evaporation rate of the solvent from the ink, i.e. the amount of evaporation of the solvent from the ink per unit time per unit area, and the evaporation rate of the solvent depends on an ambient temperature. The ink jet printer according to this preferred embodiment determines the evaporation rate of the solvent from the ink from the measured value of the ambient temperature, determines the amount of evaporation of the solvent from the ink over a very short time period based on the evaporation rate of water from the ink and the time period measured by the time-measuring means, and cumulates the amount of evaporation of the solvent from the ink over the very short time period to obtain a cumulative amount of evaporation of the solvent from the ink. Based on the cumulative amount of the solvent from the ink, it is possible to determine suitable timing which fulfills necessary and sufficient conditions in executing removal of thickened ink adhering to the print head. This enables the ink jet printer to flexibly cope with changes in the environment.

Further preferably, the thickened ink-removing means includes memory means storing a conversion table for converting the ambient temperature to the evaporation rate of the solvent from the ink, and the computing means determines the evaporation rate of the solvent from the ink with reference to the conversion table.

According to this preferred embodiment, by storing the conversion table, the evaporation rate of the solvent from the oil-soluble ink can be easily determined by referring to the table. Further, the same advantageous effects as obtained for the water-soluble ink can be obtained.

For example, the solvent is kerosene.

Preferably, the ink jet printer includes a main power supply for supplying electric power to the ink jet printer for a printing operation thereof, and an auxiliary power supply for supplying electric power to the time-measuring means, the evaporation rate parameter-measuring means and the thickened ink-removing means when the main power supply is off.

According to this preferred embodiment, when the main power is off, the time-measuring means, the evaporation rate parameter-measuring means, and the thickened ink-removing means are supplied with electric power by the auxiliary power supply. Therefore, even if the main power supply is off, the thickened ink can be removed without any problem. This enables the present ink jet printer to preserve the above advantageous features thereof to thereby permit the use thereof immediately as desired by the user.

The above and other objects, features, and advantages of the invention will become apparent from the following detailed description taken in conjunction with the accompanying drawings.

DETAILED DESCRIPTION

The invention will now be described in detail with reference to the drawings showing an embodiment thereof. According to an ink jet printer of the present invention, flushing is carried out so as to remove thickened ink adhering to a print head in a non-printing state in which the print head of the ink jet printer is in intimate contact with a head cap thereof.

Figure 1:
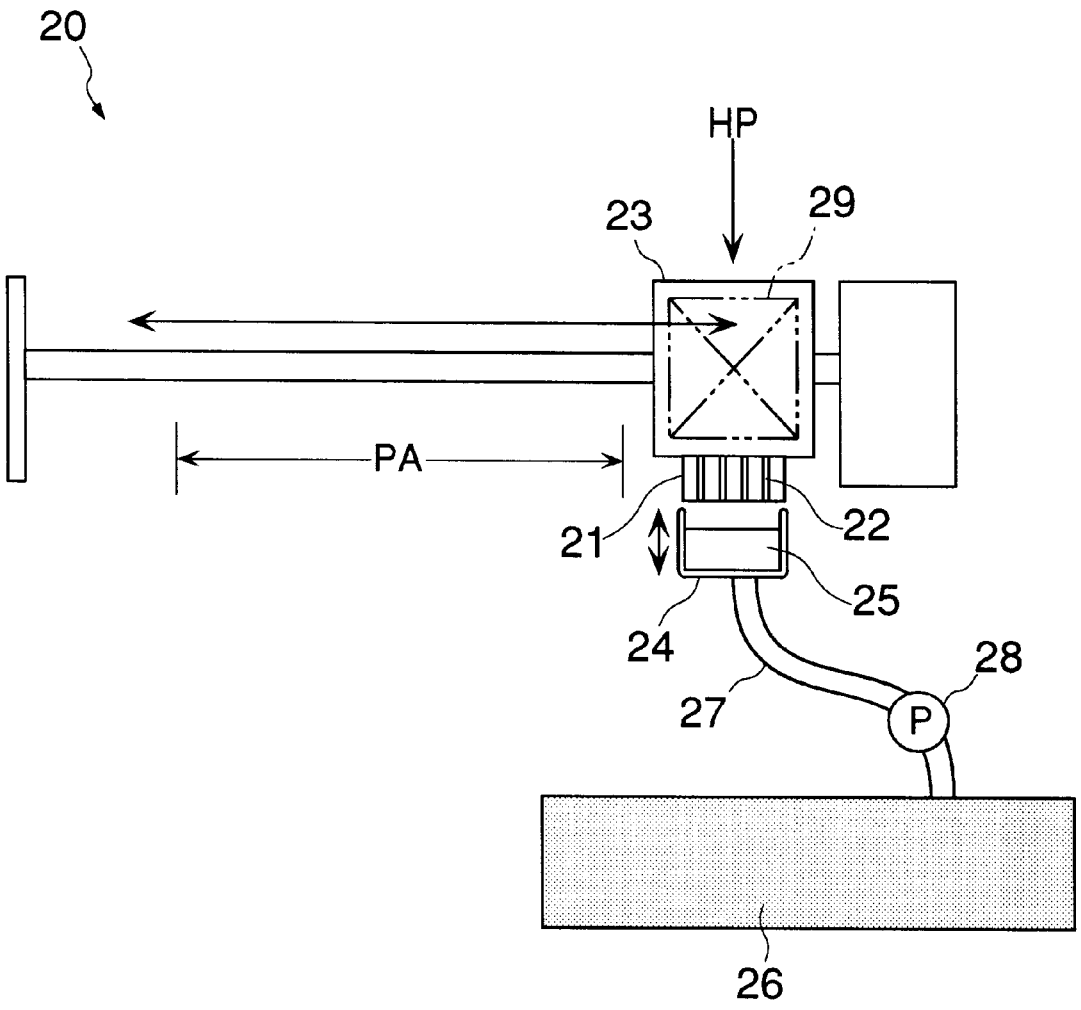
F I G. 1 PRIOR ART
FIG. 1 is a schematic diagram which is useful in explaining how flushing is carried out for a printing block of a conventional ink jet printer.
Figure 2:
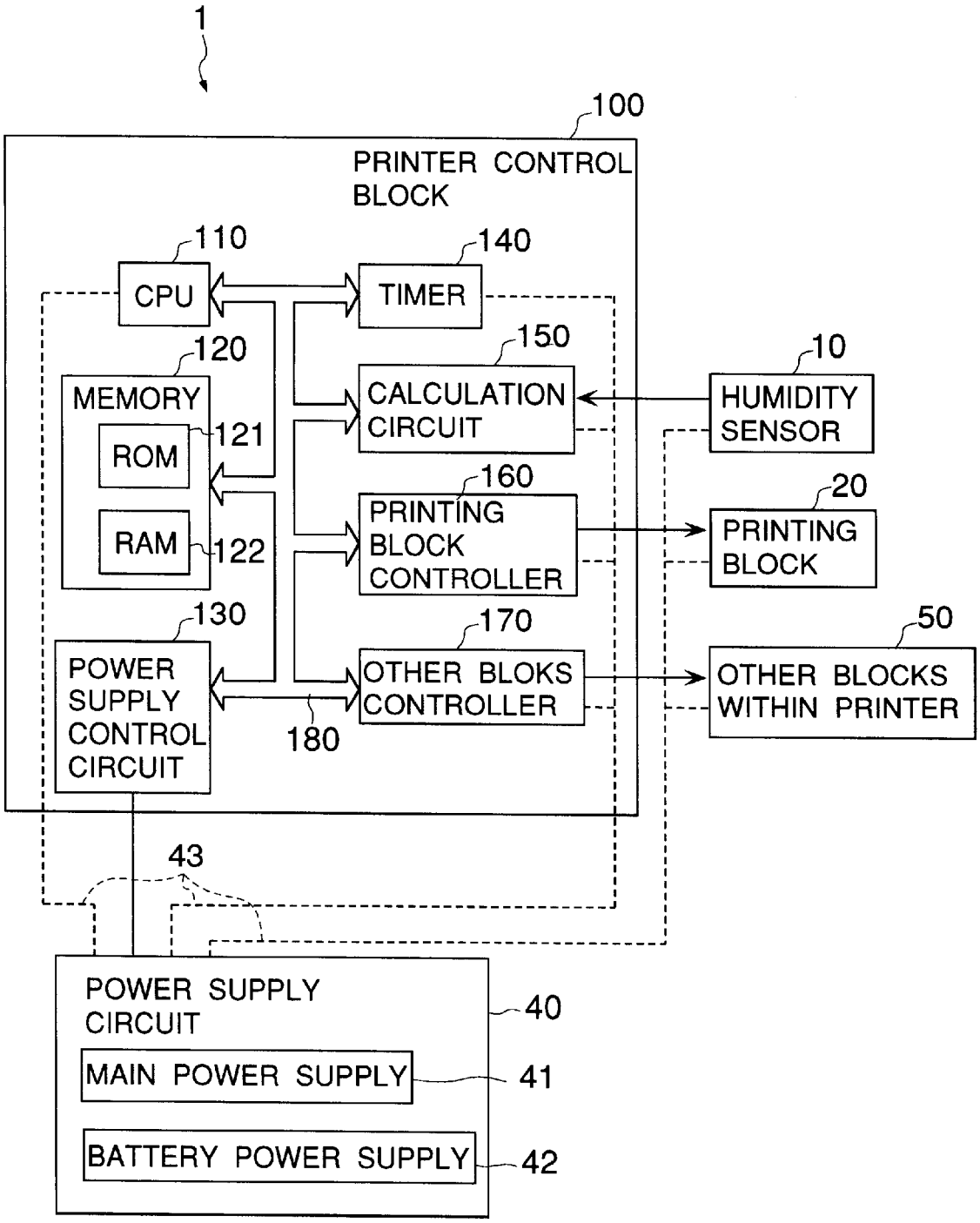
FIG. 2 is a block diagram showing the arrangement of an ink jet printer according to a first embodiment of the invention.

Referring first to FIG. 2, there is shown an ink jet printer 1 according to the embodiment of the invention, which is comprised of a printer control block 100, a humidity sensor (evaporation rate parameter-measuring means) 10 for measuring a relative humidity, a printing block (thickened ink-removing means) 20 for carrying out printing and flushing described under the heading of Prior Art with reference to FIG. 1, a power circuit (main/auxiliary power supplies) 40, and other blocks 50 connected to the printer control block 100. The ink used in the present embodiment is a water-soluble ink.

This ink jet printer 1 is similar to conventional or typical ink jet printers except for features of the present invention which will be described in detail hereinbelow. Therefore, in FIG. 2, component parts and elements which are not essential to the present invention are collectively shown as other blocks 50, and detailed description thereof is omitted. Further, the printing block 20 has a construction similar to that of the conventional one. Therefore, the description made of the printing block 20 of the conventional ink jet printer hereinabove under the heading of Prior Art is substituted for description of the printing block 20 of the present embodiment, and description of the construction or the like of the printing block 20 of the ink jet printer of the present embodiment will be omitted. The printing block 20, however, is used not only for typical flushing described hereinbefore, but also for regular flushing carried out during a non-printing period, described hereinafter. For this reason, the printing block 20 is shown separately from the other blocks 50.

Operations of the whole ink jet printer 1 are controlled by the printer control block 100. As shown in FIG. 2, the printer control block 100 includes a CPU 110 and a memory (memory means) 120, as well as a power supply control circuit 130 for controlling the power circuit 40, a timer (time-measuring means) 140 for measuring a time period over which the ink jet printer is in the non-printing state, referred to hereinafter, and the like, a calculation circuit (computing means) 150 for carrying out a calculation required for determining timing of flushing, referred to hereinafter, based on information from the humidity sensor 10 and the timer 140, and other calculating processes, a printing block controller 160 for controlling the printing block 20 in response to a command from the CPU 110 for normal printing operations and flushing, and other blocks controllers 170 for controlling the other blocks 50. The above components forming the printer control block 100 are connected to each other via an internal bus 180. The other blocks controllers 170 are collectively shown in a simplified manner similarly to the other blocks 50.

The memory 120 includes a ROM 121 and a RAM 122. The ROM 121 stores a program for executing a regular flushing process, described in detail hereinafter, as well as other control programs for controlling blocks within the ink jet printer 1, while the RAM 122 stores various kinds of data including a conversion table and a battery-on flag, referred to hereinafter, as well as data for normal printing operations. The CPU 110 processes data in the RAM 122 according to programs stored in the ROM 121 to deliver control signals to respective blocks via the internal bus 180. Thus, the printer control block 100 as a whole controls the entire ink jet printer 1.

The power circuit 40 includes a main power supply 41 for supplying electric power to the ink jet printer for normal operations thereof, and a battery power supply 42 as an auxiliary power supply. The power circuit 40 supplies electric power to devices or blocks within the ink jet printer 1 via a power supply cable 43. The battery power supply 42 supplies electric power to devices or blocks within the ink jet printer 1, particularly to the printer control block 100, the humidity sensor 10 and the printing block 20, in place of the main power supply 41 when the main power supply 41 is off. This makes it possible to carry out the regular flushing process even when the main power supply 41 is off. The power circuit 40 is also controlled by the CPU 110 via the power supply control circuit 130.

The ink jet printer 1 according to the present embodiment carries out the regular flushing process (i.e. process for removing thickened ink), as an essential feature of the present invention, by the printer control block 100, the humidity sensor 10, the printing block 20 and the power circuit 40 including the battery power supply 42.

Figure 4:
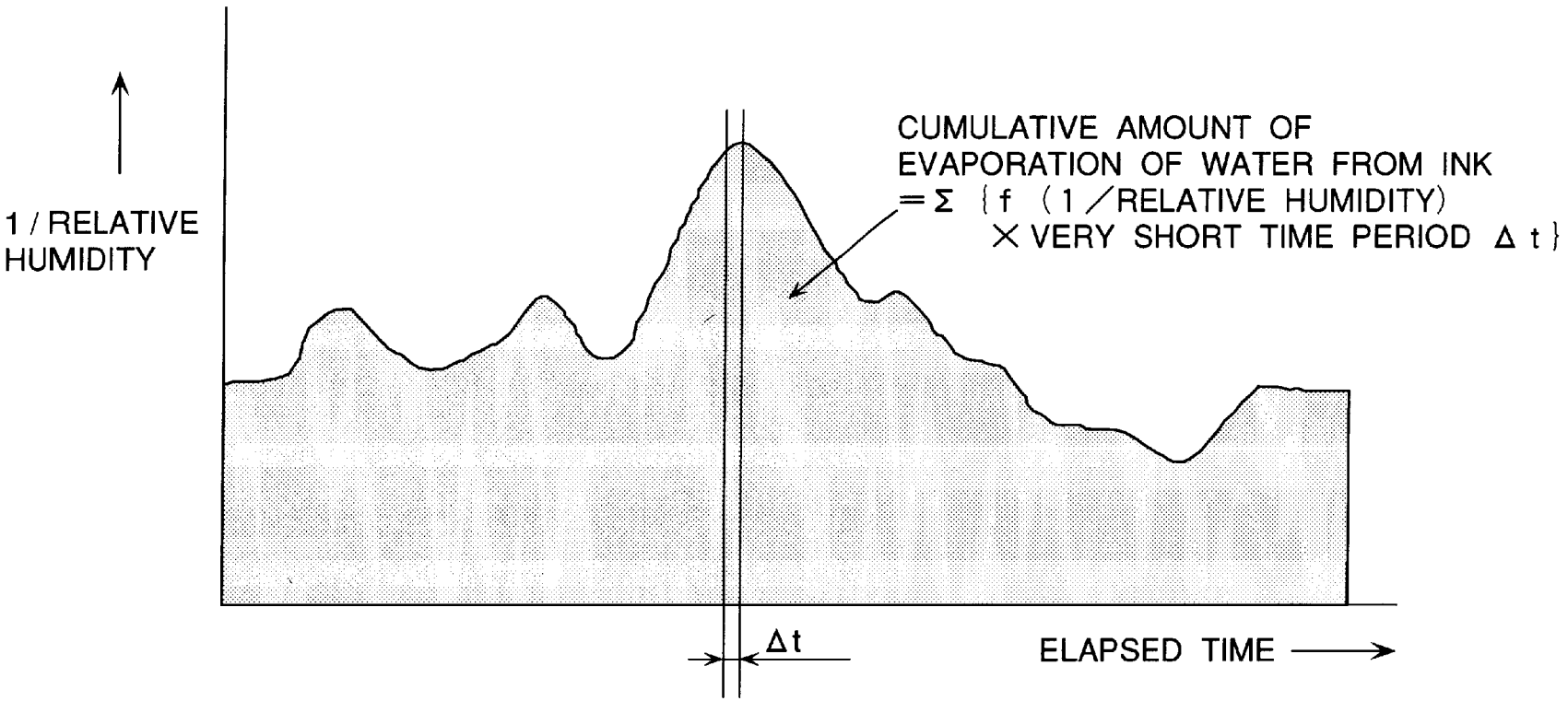
FIG. 4 is a diagram which is useful in explaining an amount of evaporation of water over a very short time period and a cumulative amount of evaporation of water.

Next, the relationship between timing of regular flushing and a cumulative amount of evaporation of water from ink will be described. It should be noted that since the ink jet printer of the present embodiment uses the water-soluble ink, a component (solvent) which evaporates from the ink is water. An evaporation rate of water from the ink, i.e. an amount of evaporation of water from the ink per unit time per unit area can be estimated based on a relative humidity as a parameter thereof. When the (reciprocal of) relative humidity varies with elapsed time as indicated by a curve in FIG. 4, the evaporation rate of water from the ink can be represented by a function f(x) (x=1/relative humidity) based on a characteristic of the ink. Therefore, it is possible to obtain a cumulative amount of evaporation of water from the ink per unit area by cumulating the evaporation rate f(x) corresponding to a very short time period Δt over the elapsed time. Assuming that the evaporation rate of water from the ink is proportional to the reciprocal of relative humidity, the cumulative amount of evaporation of water per unit area is proportional to an area between the curve and time axis of a graph as shown in FIG. 4.

Figure 5:
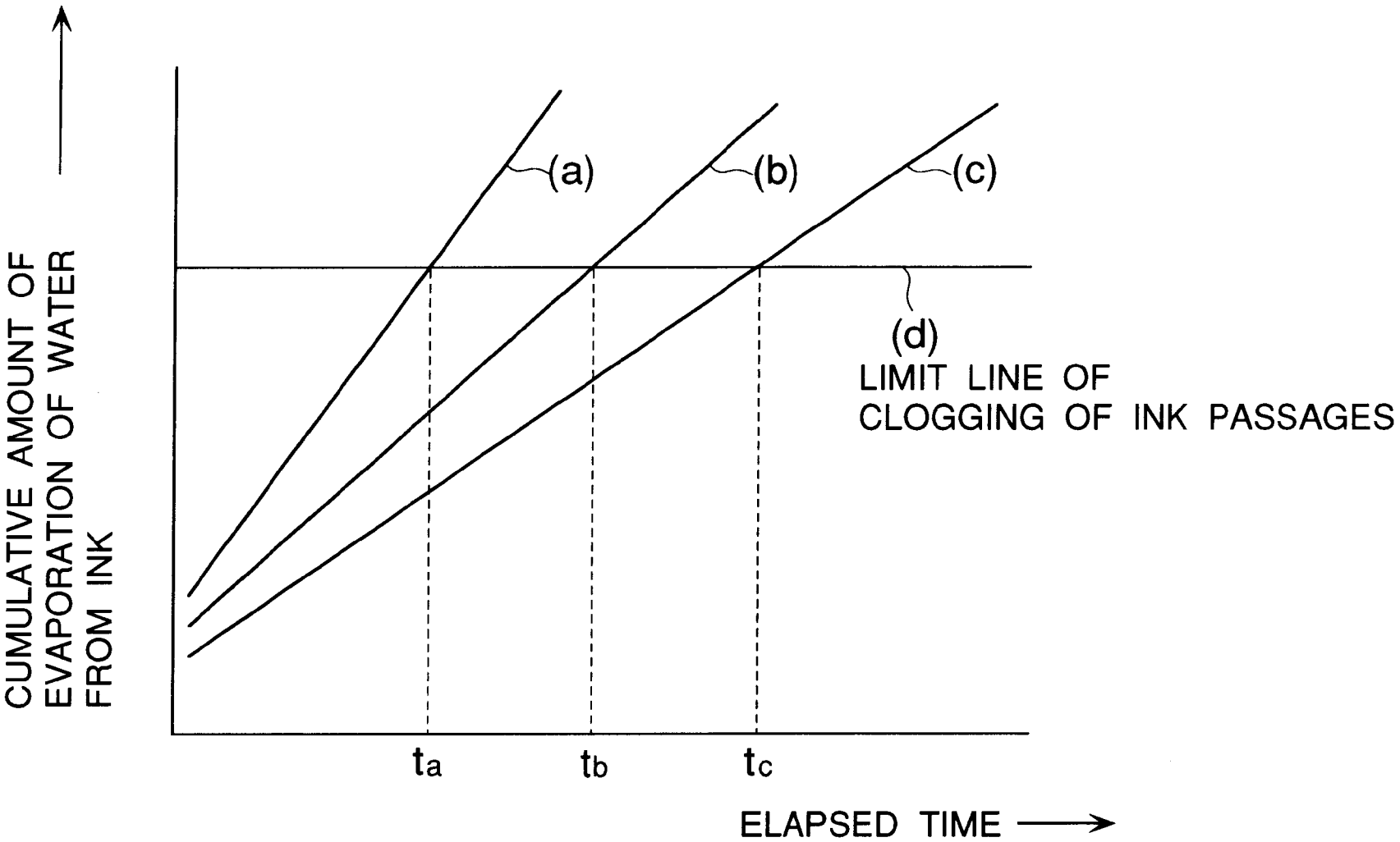
FIG. 5 is a diagram which is useful in explaining relationship between timing of regular flushing and the cumulative amount of evaporation of water from ink.

For easy understanding purposes, let it be assumed that three curves (a), (b), and (c) shown in FIG. 5 represent cumulative amounts of evaporation of water from inks, with different inclinations indicative of respective constant evaporation rates of water from the inks which are different from each other due to difference in characteristics of inks and relative humidity. In the figure, (d) designates a limit line of the cumulative amount of evaporation of water from each ink, beyond which ink passages including the nozzles 22 (see FIG. 1) of the print head 21 are clogged, i.e. beyond which each ink becomes dry and solidifies within the ink passages, thereby hindering the user from using the printer immediately next time. As can be seen from the figure, time points at which flushing is necessitated (timing of flushing) for the curves (a), (b), and (c) are indicated by $t_a$, $t_b$, and $t_c$, respectively.

On the other hand, the provision of a conversion table TB for converting a value of relative humidity hum to a value of evaporation rate V(hum) of water from ink makes it unnecessary to calculate the function f(x) based on the characteristic of ink, but makes it possible to obtain the evaporation rate V(hum) of water from the ink by retrieving the table TB, and hence the cumulative amount of evaporation of water from the ink based on the evaporation rate V(hum) and a very short time period Δt with ease.

To this end, the ink jet printer 1 has the above conversion table TB stored in the RAM 122, which is retrieved or referred to according to data of the relative humidity hum as a result of measurement by the humidity sensor 10, to determine an evaporation rate V(hum). From the evaporation rate V(hum) and the elapsed time measured by the timer 140, an amount f(x)×Δt of evaporation of water from the ink over a very short time period Δt is obtained. This amount of evaporation of water is cumulated to obtain a cumulative evaporation amount VAP, whereby suitable timing of flushing which fulfills necessary and sufficient conditions for carrying out flushing is determined. The conversion table TB is set, for example, based on data obtained from actual measurements of evaporation rates of water in relation to the relative humidity carried out on respective various kinds of ink, and stored in the RAM 12.

Further, in addition to the above conversion table TB, there may be provided a conversion table TB2 for determining an amount f(x)×Δt of evaporation of water from the ink per very short time period by using arguments of the evaporation rate V(hum) and the very short time period Δt. By retrieving the conversion table TB2, the calculation of the function f(x)×Δt can be also omitted. Further, there may be employed a conversion table TB3 for directly determining an amount f(x)×Δt of evaporation of water from the ink per very short time period by using arguments of the relative humidity hum and the very short time period Δt.

Next, the regular flushing process executed by the ink jet printer 1 will be described with reference to FIG. 3. When normal printing operation is terminated, a carriage 23 returns to a home position HP, where normal flushing to be carried out after termination of printing operation is carried out. When the normal flushing is completed, the head cap 24 is brought into intimate contact with the print head 21 for covering the same, and the ink jet printer enters the non-printing state, waiting for a next printing operation to start. At this time point, the ink jet printer 1 starts a routine for the regular flushing process.

Figure 3:
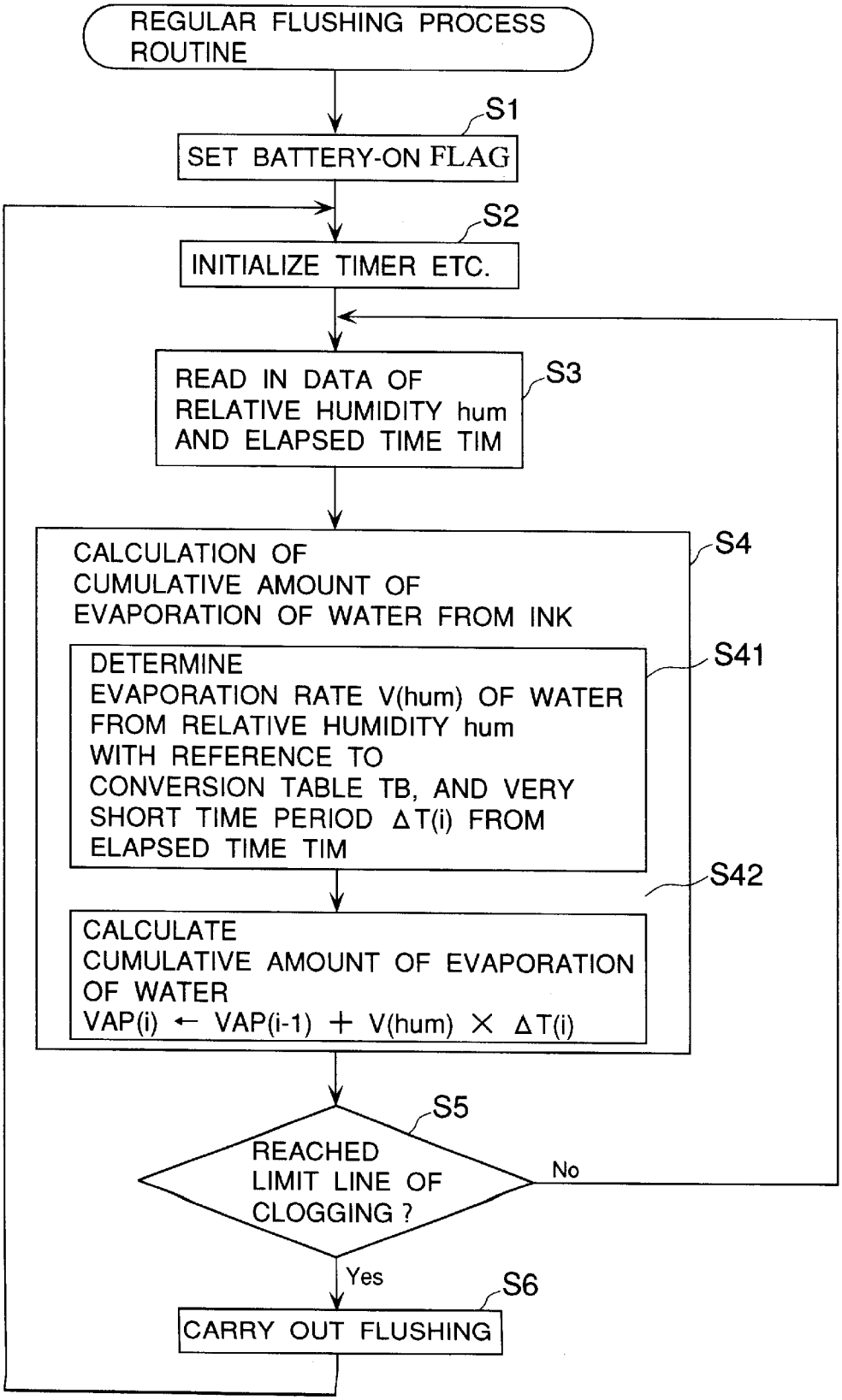
FIG. 3 is a flowchart showing a regular flushing process routine executed by the FIG. 2 ink jet printer.

As shown in FIG. 3, when the routine for the regular flushing process is started, a battery-on flag is set so as to enable the battery power supply 42 to be turned on to continue execution of the regular flushing process even after the main power supply 41 is turned off. That is, when the main power supply is turned off, the ink jet printer 1 executes, e.g. by interrupt handling, after-processing for saving various kinds of data and information on various flags in a save area within the RAM 122, at the same time turns on the battery power supply 42 according to the battery-on flag, and then stops power supply from the main power supply 41. The switch-on of the battery power supply 42 makes it possible to secure electric power for the printer control block 100, the humidity sensor 10, and the printing block 20 during the time period over which the main power is off (step S1). In this case, the other blocks controllers 170 in the printer control block 100 are disconnected from the power supply system if necessary. However, if the controllers are of types which do not consume electric power when they are not in operation, they may be left connected to the power supply system.

When the electric power has been secured (step S1), the timer 140 and other devices are initialized (step S2). The timer 140 may be a resettable type or a type which stores data of a time point of initialization and measures an elapsed time period by measuring a difference between the time point and the present time point to deliver an electric signal indicative of the measured elapsed time period. If the ink jet printer has a timer installed therein for control of the date and time or the like for control of operation of the printer, this timer can be substituted for the latter of the two types mentioned above for calculation of an elapsed time period based on data of the date and time indicated thereby. Similarly to the timer 140, the humidity sensor 10 is initialized as required. Further, the cumulative evaporation amount VAP(i) is initialized to "0" (i.e. VAP(i) =0, where "i" represents a variable corresponding to a very short time period ΔT(i), and i=0 holds when the cumulative evaporation amount VAP(i) is initialized), followed by terminating the initialization (step S2).

When the initialization (step S2) is terminated, an elapsed time period TIM from the time point of the ink jet printer entering the non-printing state, i.e. a time period TIM over which the ink jet printer continues to be in the non-printing state is measured by the timer 140, and at the same time, the relative humidity hum at this time point is measured by the humidity sensor 10. Results of the measurements are read and stored as data for processing in the RAM 122 (step S3).

After acquiring data of the relative humidity hum and the elapsed time period TIM, the cumulative evaporation amount VAP(i) is calculated (step S4). At this step, the evaporation rate V(hum) is determined from the relative humidity hum with reference to the conversion table TB and at the same time an elapsed time period from the time point of immediately preceding calculation of the evaporation rate V, i.e. a very short time period ΔT(i) is determined from the data of the elapsed time period TIM (S41). Then, the amount of evaporation of water over the very short time period ΔT(i) is determined from the evaporation rate V(hum) and the very short time period ΔT(i). The amount of evaporation of water over the very short time period ΔT(i) is added to the immediately preceding value VAP(i−1) of the cumulative evaporation amount VAP to thereby obtain the present cumulative evaporation amount VAP(i). That is, the present cumulative evaporation amount VAP(i) is calculated by the use of the following equation: VAP(i)=VAP(i−1)+V(hum)×ΔT(i) (step S42). At this time point, since the routine is initially executed, "i" is equal to "1", and hence the immediately preceding value VAP(i−1) of the cumulative evaporation amount VAP is equal to "0". Therefore, the cumulative evaporation amount VAP(1) in a first-time loop is obtained by the use of the following equation: VAP(1)=V(hum)×ΔT(1).

When calculation of the cumulative evaporation amount VAP(i) (step S4) is completed, it is determined whether or not the cumulative evaporation amount VAP(i) has reached the limit line beyond which the ink passages will be clogged (step S5). If the cumulative evaporation amount VAP(i) has not reached the limit line (i.e. the answer to the question of the step S5 is negative (NO)), data of the relative humidity hum and the elapsed time TIM is obtained again (step S3), and then the cumulative evaporation amount VAP(i) is calculated(step S4) similarly to the above. By this processing, the cumulative evaporation amount VAP(2) in a second-time loop (VAP(2)=VAP(1)+V(hum)×ΔT(2)) is obtained. The unit time ΔT(2) represents an elapsed time period from the time point of immediately preceding calculation of the evaporation rate V and hence the cumulative evaporation amount VAP(1).

Next, similarly to the processing in the first-time loop (i=1), it is determined whether or not the cumulative evaporation amount VAP(2) has reached the limit line (step S5), and if the cumulative evaporation amount VAP(2) has not reached the limit line (i.e. the answer to the question of the step S5 is negative (NO)), reading of data of the relative humidity hum and the elapsed time period TIM (step S3), calculation of the cumulative evaporation amount VAP(i) (step S4), and determination as to whether the cumulative evaporation amount VAP(i) has reached the limit line (step S5) are carried out repeatedly, i.e. in a third-time loop (i=3), a fourth-time loop (i=4), . . . , at time intervals of a predetermined sampling period, until the cumulative evaporation amount VAP(i) reaches or exceeds the limit line.

If the cumulative evaporation amount VAP(i) reaches or exceeds the limit line (i.e. if the answer to the question of the step S5 is affirmative (YES)), flushing (the regular flushing) is carried out (step S6). In the flushing, a very small amount of ink is delivered through all the nozzles 22 of the print head 21 to thereby prevent the nozzles 22 of the print head 21 and the like from being clogged due to solidified ink.

After completion of the flushing (step S6), the initialization is executed again (step S2), and then reading of data of the relative humidity hum and the elapsed time period TIM (step S3), calculation of a cumulative evaporation amount VAP(i) (step S4), and determination as to whether the cumulative evaporation amount VAP(i) has reached the limit line (step S5) are repeatedly carried out starting with another first-time loop until the cumulative evaporation amount VAP(i) reaches the limit line. If the cumulative evaporation amount VAP(i) reaches the limit line (i.e. if the answer to the question of the step S5 is affirmative (YES)), the flushing is carried out (step S6). This loop (steps S2 to S6) is repeatedly executed until printing is resumed, i.e. until the non-printing state is canceled.

When the main power supply 41 is turned on again for printing, the ink jet printer 1 starts electric power supply from the main power supply 41 again, and turns off the battery power supply 42. Then, an initialization, such as restoring of the various kinds of data and information on the various flags from the save area in the RAM 122 where they were saved is executed by another interrupt-handling routine or the like, not shown, and the ink jet printer enters the non-printing state, waiting for a next printing operation to be started again. When the printing is started again, the ink jet printer exits from the loop (steps S2 to S6 in FIG. 3) of the regular flushing process routine to terminate the same, followed by returning to a normal routine for printing operations, etc.

As described above, the ink jet printer 1 of the present embodiment carries out flushing even during a non-printing period at suitable timing, so that even if the printer 1 is left in the non-printing state for a long time, the print head 21 and other ink passages are maintained free of thickened ink, which makes it possible to use the ink jet printer immediately as the user desires. Further, according to the ink jet printer of the invention, the relative humidity hum is measured, and the amount V×ΔT of evaporation of water over a very short time period ΔT is obtained based on the measured relative humidity hum and the elapsed time period, and then from the cumulative evaporation amount VAP obtained by cumulating the amount of evaporation over the very short time period, timing which fulfills necessary and sufficient conditions for carrying out flushing is determined. This enables the ink jet printer 1 to carry out efficient regular flushing and at the same time cope with changes in the environment appropriately and flexibly.

Further, the ink jet printer 1 has the battery power supply 42 as an auxiliary power supply for supplying electric power during a time period over which the main power supply 41 is off, and carries out flushing by the use of the electric power from the battery power supply 42, so that it is possible to carry out flushing without any inconveniences even during a non-printing period when the main power supply is off. This enables the ink jet printer 1 to preserve the above advantageous features thereof to permit the use thereof immediately as desired by the user.

Further, according to the ink jet printer of the present embodiment, by storing the conversion table TB, the evaporation rate V can be easily determined by retrieving the table TB. The use of the conversion table TB makes the ink jet printer 1 adaptable to use of a different kind of a water-soluble ink which has different characteristics, not by changing the construction of component parts, but simply by updating or changing values of the table TB. Further, when a plurality of kinds of water-soluble inks are used for printing, conversion tables TB can be provided respectively for these kinds of inks and stored in the RAM 122, which makes the ink jet printer 1 applicable to wider ranges of inks.

Further, in the above embodiment, description is made of an ink jet printer which uses a water-soluble ink, this is not limitative but the present invention can be applied to an ink jet printer which uses an oil-soluble ink. In the case of the oil-soluble ink, a solvent thereof, e.g. kerosene, evaporates to thicken the ink, i.e. form thickened ink, and therefore it is necessary to measure an amount of evaporation of such a solvent. In the case of kerosene, its evaporation rate or amount of evaporation of the same per unit time per unit area depends on a temperature, so that in place of the humidity sensor 10, a temperature sensor is used to measure the ambient temperature. The conversion table TB is also replaced by one for converting a measured value of an ambient temperature to an evaporation rate or an amount of evaporation of the solvent (kerosene). Thus, in the case of the ink jet printer which uses the oil-soluble ink as well, the evaporation rate of the solvent thereof is determined from a parameter related thereto measured by a suitable sensor. Then, an amount of evaporation of the solvent from the ink over a very short time period is determined based the evaporation rate of the solvent from the ink and the elapsed time period. The amount of evaporation of the solvent from the ink over the very short time period is cumulated to obtain the cumulative amount of evaporation of solvent, based on which timing of flushing is determined.

Although, in the above embodiment, timing of flushing is determined by determining whether or not the cumulative amount of evaporation of water from ink has reached the limit line beyond which the ink passages will be clogged, this is not limitative, but when a time period which will elapse before the cumulative evaporation amount reaches the limit line is predictable, it is possible to carry out regular flushing more simply, only based on the predicted time period, e.g. at time intervals of a couple of months.

Further, although, in the routine for the regular flushing process described above with reference to FIG. 3, the initialization is carried out again (step S2) after executing the flushing (step S6), this is not limitative but, as is apparent from the above description that not only the timer of a resettable type but also the timer of a type which calculates an elapsed time can be employed as the timer 140, it is also possible to store data of a date and time when the immediately preceding flushing (step S6) was carried out and calculate a time period which has elapsed from the time point of execution of the flushing as the elapsed time period TIM. Still further, when flushing is carried out regularly, e.g. once every two months, based on the elapsed time period alone, it is possible to reset the timer once every two months whenever the flushing is executed (S6), for measuring another two-month period, or otherwise, a total elapsed time from the beginning of the initial flushing may be detected as a two-month period, a four-month period, a six-month period. . . so as to carry out the flushing (step S6) on a two-month basis.

Further, although, in the present embodiment, the battery power supply 42 is used as an auxiliary power supply, a rechargeable backup battery which is charged while a line cord plug of the ink jet printer 1 is inserted in a receptacle of an external power supply may also be employed as an auxiliary power supply. Further, it is possible to provide an electric power system designed specifically for the block or component parts for carrying out the regular flushing process, other than the electric power system for the other blocks or component parts within the ink jet printer 1, such that the block or component parts involved in the regular flushing process can be supplied with electric power from the main power supply when the ink jet printer 1 is connected to the external power supply, and from the backup battery power supply or the battery power 42 when the line cord plug of the ink jet printer 1 is disconnected from the external power supply. Further, a timer (time-measuring means) and other devices may be driven by a flat spiral spring or a solar battery instead of the above-mentioned power supplies.

Moreover, the present invention is not limited to the above embodiment, but it can be practiced in various forms.

For example, in the above embodiment, flushing is carried out so as to remove thickened ink during a non-printing period. However, so long as thickened ink can be removed, cleaning or other operations for removing thickened ink may be employed. Further, although in the above embodiment, the conversion table TB is stored in the RAM 122, it goes without saying that it may be stored in the ROM 121 together with the control programs.

Further, although in the above embodiment, the amount of evaporation of water over a very small time period is calculated, and then the cumulative amount of evaporation of water is obtained, this is not limitative, but the cumulative amount of evaporation of water (solvent) from the ink may be determined by executing the routine for the regular flushing process shown in FIG. 3 at time intervals of a very short time period to directly convert the relative humidity to the amount of evaporation per very short time period by the use of the conversion table TB and the like, and accumulate the same, thereby omitting the determination of the very short time period from the elapsed time and multiplying of the evaporation rate by the very short time period.

Further, in the above embodiment, as the non-printing state of the ink jet printer, a state is contemplated in which the print head 21 is in the home position HP after termination of a normal printing operation with the head cap 24 being brought into intimate contact with the print head 21 to cover the same, this is not limitative, but it is also possible to modify the present ink jet printer such that it is capable of coping with a case where the printer enters a non-printing state in which no ink is either delivered or drawn with the print head 21 being not covered by the head cap 24, e.g. due to a sudden removal of the line cord plug of the ink jet printer from the receptacle of the external power supply.

For this modification, it is only required to change a main control program of the ink jet printer 1 such that when it is detected that the ink jet printer 1 has entered the non-printing state in which no ink is delivered or drawn due to some cause, the regular flushing process is always started prior to other processing through multitasking or interrupt handling, whereby when a printing operation resumes, the ink jet printer 1 is caused to return to its normal printing program routine.

More specifically, as described hereinabove with reference to FIG. 3, the battery-on flag is set on the instant the regular flushing process routine is started, so that by the above modification, even if the ink jet printer 1 enters the non-printing state due to a sudden removal of the plug thereof from the receptacle of the external power supply, after-processing is executed by a subsequent interrupt handing to store various kinds of data and information on various kinds of flags in the save area, and at the same time, the battery power supply 42 is turned on by referring to the battery-on flag before electric power supply from the main power supply 41 stops. Therefore, it is possible to continue carrying out the regular flushing process.

In this connection, when the control program is modified as described above, the carriage 23 may be returned to the home position HP at the beginning of the FIG. 3 routine for regular flushing so that the print head 21 may be covered by the head cap 24 to receive ink delivered for flushing. Further, a device may be provided for covering the print head with e.g. paper or another substitute for the head cap irrespective of the position of the carriage 23. Still further, an upper surface of a paper feeder may be provided with a function of absorbing delivered ink such that ink can be delivered in any position of the print head even when no paper is being fed for printing.

What is claimed is:

1. An ink jet printer including a print head, and a head cap being brought into intimate contact with said print head to cover said print head, said print head having an area for containing an ink as a solution having a solvent, comprising:

time-measuring means for measuring a time period over which said print head is in a state in which said ink is neither delivered therefrom nor drawn therein;

evaporation rate parameter-measuring means for measuring a parameter related to an evaporation rate of said solvent from said ink; and thickened ink-removing means for removing thickened ink adhering to said print head based on a result of measurement by said time-measuring means and a result of measurement by said evaporation rate parameter-measuring means, wherein said thickened ink-removing means comprises:

memory means storing a conversion table for converting said parameter to said evaporation rate of said solvent from said ink;

computing means for determining, with reference to said conversion table, timing at which said removal of said thickened ink is to be carried out based on said time period measured by said time-measuring means and said parameter measured by said evaporation rate parameter-measuring means; and thickened ink removal-executing means for executing removal of said thickened ink adhering to said print head at said timing determined by said computing means.

2. An ink jet printer according to claim 1, wherein said ink is a water-soluble ink, said evaporation rate parameter-measuring means being a humidity sensor for measuring a relative humidity, said computing means determining said evaporation rate of water from said ink based on said relative humidity measured by said humidity sensor, successively determining an amount of evaporation of water from said ink over a very short time period, at predetermined intervals, based on said evaporation rate of water from said ink and said time period measured by said time-measuring means, calculating a total amount of evaporation of water from said ink successively determined at said predetermined intervals to obtain a cumulative amount of evaporation of water from said ink, and determining said timing at which said removal of said thickened ink is to be carried out, based on said cumulative amount of evaporation of water from said ink.

3. An ink jet printer according to claim 1, wherein said ink is an oil-soluble ink, said evaporation rate parameter-measuring means being a temperature sensor for measuring an ambient temperature, said computing means determining said evaporation rate of said solvent from said ink based on said ambient temperature measured by said temperature sensor, successively determining an amount of evaporation of said solvent from said ink over a very short time period, at predetermined intervals, based on said evaporation rate of said solvent from said ink and said time period measured by said time-measuring means, calculating a total amount of evaporation of said solvent from said ink successively determined at predetermined intervals to obtain a cumulative amount of evaporation of said solvent from ink, and determining said timing at which said removal of said thickened ink is to be carried out, based on said cumulative amount of evaporation of said solvent from said ink.

4. An ink jet printer according to claim 3, wherein said solvent is kerosene.

5. An ink jet printer according to claim 1, including a main power supply for supplying electric power to said ink jet printer for a printing operation thereof;

an auxiliary power supply, provided separately from the main power supply, for supplying electric power to said time-measuring means, said evaporation rate parameter-means and said thickened ink-removing means; and means for turning on said auxiliary power supply when said main power supply is turned off.

6. An ink jet printer according to claim 5, wherein said auxiliary power supply is a battery.

7. An ink jet printer according to claim 1, wherein said thickened ink-removing means carries out flushing to remove said thickened ink adhering to said print head.

8. An ink jet printer according to claim 7, wherein said time-measuring means is a timer which is reset whenever said flushing is carried out.

* * * * *